United States Patent [19]

Castelli

[11] Patent Number: 4,835,797

[45] Date of Patent: Jun. 6, 1989

[54] LOW PROFILE SIPHONIC FLUSH CLOSET

[76] Inventor: Cesare Castelli, Rua Otapoa s/n, Manguinhos, Serra Stato di Spirito Santo, Brazil

[21] Appl. No.: 118,559

[22] Filed: Nov. 9, 1987

[51] Int. Cl.[4] ..... E03D 1/28

[52] U.S. Cl. ..... 4/332; 4/329; 4/363

[58] Field of Search ..... 4/329–332, 4/300, 347–349, 420, 661, 353

[56] References Cited

U.S. PATENT DOCUMENTS

| | | | |
|---|---|---|---|
| 716,315 | 12/1902 | Wales | 4/332 |
| 728,624 | 5/1903 | Schuh | 4/332 |
| 1,919,700 | 7/1933 | Lundberd | 4/330 |
| 1,939,118 | 12/1933 | Hinsdale | 4/331 |
| 2,773,267 | 12/1956 | Kohlmeyer | 4/331 |
| 2,923,012 | 2/1960 | Kohlmeyer | 4/331 |
| 3,147,762 | 9/1964 | Ducey | 4/331 X |
| 3,172,128 | 3/1965 | Ducey | 4/331 |

*Primary Examiner*—Henry J. Recla
*Assistant Examiner*—Robert Fetsuga
*Attorney, Agent, or Firm*—Howson & Howson

[57] ABSTRACT

A low profile siphonic flush closet comprises a bowl having a hollow rim in communication with a flushing water tank. The hollow space within the rim holds additional flushing water, and makes it possible to reduce the tank size and thus the overall size and weight of the toilet. The tank and bowl are preferably a unitary ceramic structure, and the lower boundary of the cavity within the rim declines from the front of the rim toward the tank at the rear.

1 Claim, 2 Drawing Sheets

LOW PROFILE SIPHONIC FLUSH CLOSET

BRIEF SUMMARY OF THE INVENTION

This invention relates to siphonic flush closets, commonly known as toilets, and in particular to an efficient and practical toilet which is more compact in size, lighter in weight, and consequently easier to ship, than a conventional toilet.

A conventional toilet utilizes a tank attached to the rear of the bowl. The tank must be large enough to contain sufficient water for flushing. The tank capacity requirement therefore imposes a limit on the minimum size and weight of the overall toilet structure.

The principal object of the invention is to produce a toilet of reduced size and weight, which is practical and efficient in operation, and which can be more easily transported than a conventional toilet. This object is achieved by incorporating at least part of the water tank into the rim of the toilet bowl. Water accumulates in a cavity within the rim, and is discharged into the bowl when the toilet is flushed.

More specifically, the toilet in accordance with the invention comprises a bowl having a rim, a water tank attached to the bowl at the rear, flush valve means located at the lower portion of the water tank for discharging water from the tank into the bowl, and a cavity formed within the rim. The cavity is in communication with the water tank, and extends substantially completely around the rim, whereby flushing water can accumulate both in the tank and in the cavity.

Preferably, the lower boundary of the cavity within the rim declines continuously from the front of the bowl toward the rear, so that water accumulated within the cavity can be rapidly and substantially completely discharged through the flush valve.

The preferred form of the invention is embodied in a monoblock toilet, that is, one in which the tank and bowl are a unitary ceramic structure.

The cavity within the rim of the bowl enables the size of the tank to be reduced significantly without reducing the toilet's flushing water capacity. The invention not only reduces the size of the toilet, but also results in a weight reduction. The toilet is consequently easier to transport.

Further objects and advantages of the invention will be apparent from the following detailed description when read in conjunction with the drawings.

DETAILED DESCRIPTION

Figure 1:
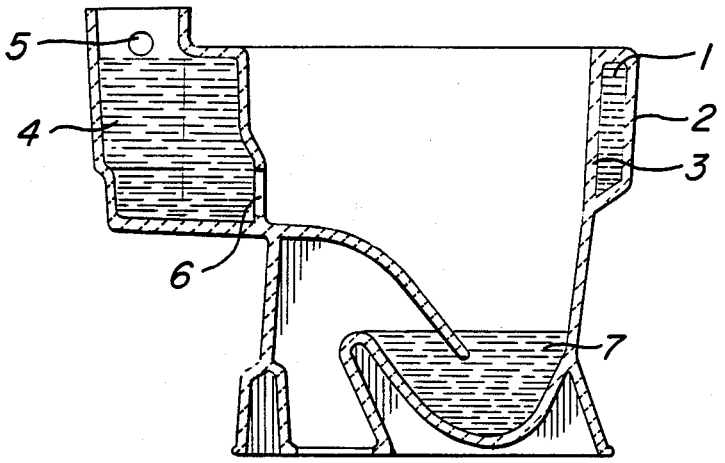
FIG. 1 is a vertical section through a flush closet in accordance with the invention, showing the water tank and the rim cavity.

As seen in FIG. 1, the toilet in accordance with the invention comprises a bowl, the rim of which is provided with a cavity 1 formed between external surface 2 and internal surface 3. The cavity extends around the interior of the rim from one side to the other of a small tank 4 which is formed at the rear of the bowl.

Figure 2:
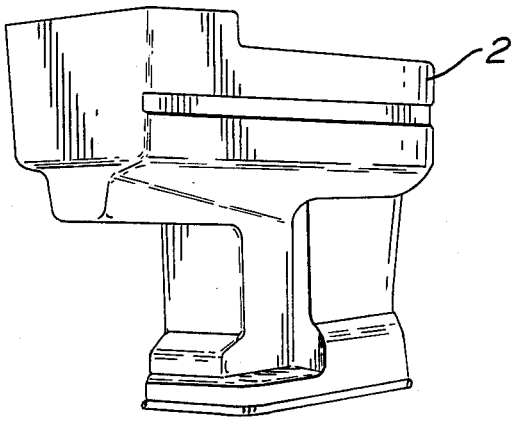
FIG. 2 is a perspective view of the toilet of FIG. 1.
Figure 3:
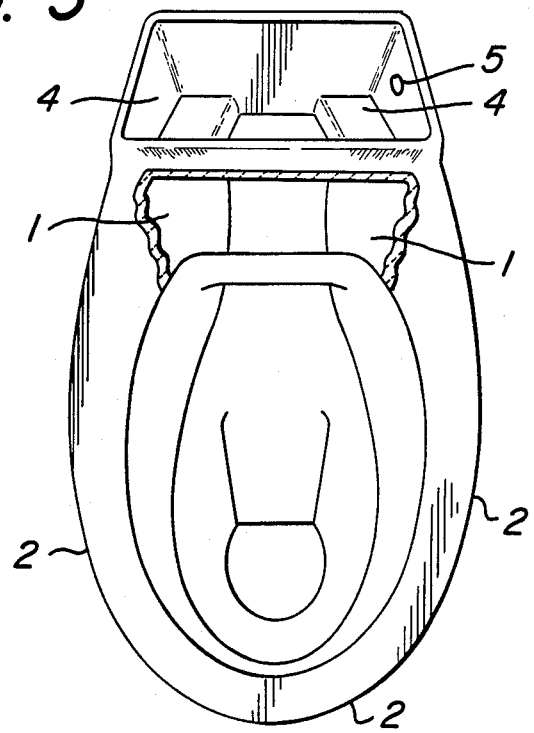
FIG. 3 is a partially broken away perspective view of the toilet, as seen from above.
Figure 4:
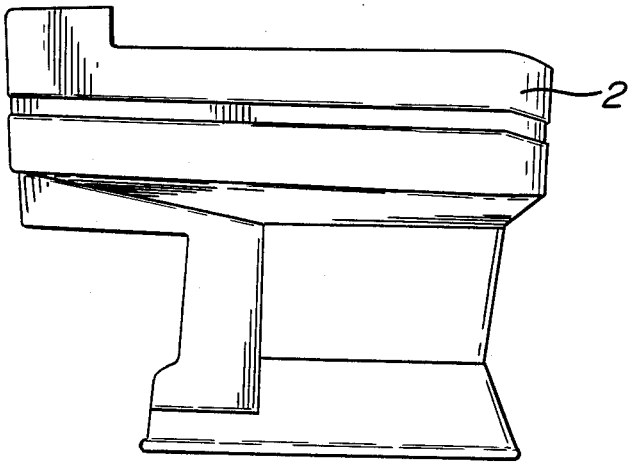
FIG. 4 is a side elevation of the toilet.

The tank and bowl are a unitary ceramic structure, as is apparent from FIGS. 2 and 4.

Tank 4 has a water inlet 5, to which can be attached a suitable float-operated valve (not shown). Provisions may be made in the toilet itself, or in exterior plumbing, to prevent overflow of tank 4 in the event of failure of the intake valve.

At the lower portion of the tank, a flush valve 6 is provided. When opened, the flush valve allows water to flow rapidly from the tank (and from cavity 1) into the bowl. A quantity of water 7, standing in the bottom of the bowl, isolates the interior of the bowl from the soil pipe. When flushing takes place, the bowl is cleared by a siphoning action, as is conventional in sanitary toilets.

The lower boundary of cavity 1, which extends around the rim, declines gradually and continuously from the front of the bowl toward the rear, so that substantially all of the water within the rim can be discharged through flush valve 6, and so that the rate of flow of water through flush valve 6 into the bowl is sufficient to initiate and maintain siphoning at the bowl outlet. Preferably, all portions of the lower boundary of cavity 1 are located above the lowermost part of the flush opening closed by valve 6.

The space within tank 4, taken together with the space within cavity 1, is preferably large enough to contain at least seven and one-half liters of water. Seven and one-half liters is sufficient to carry out adequate flushing in a toilet constructed in accordance with the invention.

The continuous decline of the lower boundary of the rim cavity from front to rear aids the flushing process by contributing to the steady, high-velocity flow of water through the flush valve when open. The structure of the toilet provides for smooth and silent flushing operation and requires somewhat less water for flushing than does a conventional toilet.

The principal advantage of the toilet in accordance with the invention, however, relates to its weight. Whereas conventional toilets on the market typically weigh around thirty kilograms, the toilet of the present invention can be made in a weight of only twenty-one kilograms, while having a comparable flushing water capacity and good performance.

I claim:

1. A low profile flush closet comprising a bowl having a siphonic outlet, a rim, and a water tank located at the rear of the bowl, said bowl, said siphonic outlet, said rim, and said water tank being a unitary ceramic structure, flush valve means located at the lower portion of the water tank for discharging water from the tank into the bowl, wherein the improvement comprises a cavity formed within said rim, said cavity being in communication with the water tank and extending substantially completely around the rim, whereby substantially all of the flushing water for said flush closet accumulates and is stored in said tank and in said cavity said cavity further including a lower boundary declining continuously from the front of the bowl toward the rear whereby water stored within the cavity can be rapidly and substantially completely discharged through the flush valve upon opening thereof.

* * * * *